US010748431B2

(12) United States Patent
Joyson et al.

(10) Patent No.: US 10,748,431 B2
(45) Date of Patent: Aug. 18, 2020

(54) AIRFIELD TRAFFIC STATUS MANAGEMENT

(71) Applicant: Honeywell International Inc., Morris Plains, NJ (US)

(72) Inventors: John Premnath Joyson, Reading (GB); Rajesh V. Poojary, Bangalore (IN); Maksood Moidin Kadike, Dubai (AE)

(73) Assignee: Honeywell International Inc., Morris Plains, NJ (US)

( * ) Notice: Subject to any disclaimer, the term of this patent is extended or adjusted under 35 U.S.C. 154(b) by 358 days.

(21) Appl. No.: 15/815,481

(22) Filed: Nov. 16, 2017

(65) Prior Publication Data

US 2019/0147750 A1 May 16, 2019

(51) Int. Cl.
*G08G 5/00* (2006.01)

(52) U.S. Cl.
CPC ..... *G08G 5/0043* (2013.01); *G08G 5/0013* (2013.01); *G08G 5/0026* (2013.01); *G08G 5/0039* (2013.01)

(58) Field of Classification Search
CPC .. G08G 5/0026; G08G 5/0039; G08G 5/0013; G08G 5/0043
See application file for complete search history.

(56) References Cited

U.S. PATENT DOCUMENTS

2012/0245836 A1* 9/2012 White ..... G08G 5/065 701/120
2018/0373246 A1* 12/2018 Laughlin ..... G06Q 10/06311

* cited by examiner

*Primary Examiner* — Nga X Nguyen
(74) *Attorney, Agent, or Firm* — Brooks Cameron & Huebsch, PLLC

(57) ABSTRACT

Methods, devices, and systems for airfield traffic status management are described herein. One device includes a memory, and a processor to execute executable instructions stored in the memory to receive airport information associated with an airport, generate, using the airport information, an aircraft arrival and departure analysis, where the aircraft arrival and departure analysis includes aircraft scheduled to arrive at the airport in a graphical view and aircraft scheduled to depart from the airport in the graphical view, where the graphical view includes a graphical representation of an amount of aircraft scheduled to arrive at or depart from the airport for a particular time period, and display the aircraft arrival and departure analysis in a single integrated display.

19 Claims, 6 Drawing Sheets

AIRFIELD TRAFFIC STATUS MANAGEMENT

TECHNICAL FIELD

The present disclosure relates to methods, devices, and systems for airfield traffic status management.

BACKGROUND

Aircraft and airport terminal traffic analysis can be a major challenge for airports with significant air traffic and passenger throughput. Maintaining a fast and efficient throughput for both airline traffic associated with an airport and passenger traffic through the airport can reduce delays and costs for airlines and passengers.

Maintaining efficient throughput for both airline traffic and passenger traffic can be challenging. Airports can experience terminal side delays of passenger traffic that can be caused by crowds at airline check-in counters, security gates, airport transit system delays, and/or customs/immigration checkpoints, among other causes of terminal side delays. Airports may also experience airside delays of airline traffic that can be caused by a large volume of air traffic at the airport, and/or can also be a result of the terminal side delays of passenger traffic, among other causes of airside delays. Delays on the airside and/or the terminal side can result in delayed flights, or cause passengers to miss flights altogether. Further, these airside and terminal side delays can propagate to future flights at the airport and/or at other airports as well.

Airport infrastructure is typically fixed. On the airside, an airport infrastructure typically has a fixed number of runways, taxiways, aircraft stands, etc. On the terminal side, an airport infrastructure typically has a fixed number of passenger vehicle parking spaces, airline check-in counters, security gates, customs/immigration counters, boarding gates, etc.

DETAILED DESCRIPTION

Figure 1:
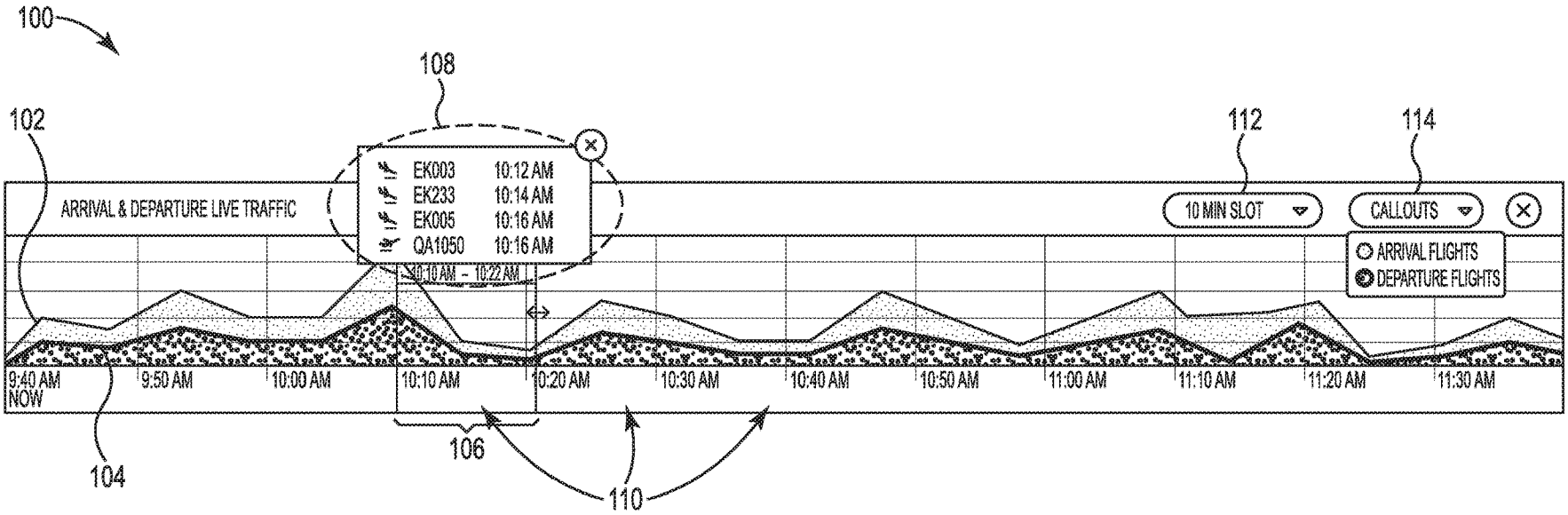
FIG. 1 is an illustration of a display provided on a user interface showing an aircraft arrival and departure analysis in a graphical view, generated in accordance with embodiments of the present disclosure.

Methods, devices, and systems for airfield traffic status management are described herein. One device includes a memory, and a processor to execute executable instructions stored in the memory to receive airport information associated with an airport, generate, using the airport information, an aircraft arrival and departure analysis, where the aircraft arrival and departure analysis includes aircraft scheduled to arrive at the airport in a graphical view and aircraft scheduled to depart from the airport in the graphical view, where the graphical view includes a graphical representation of an amount of aircraft scheduled to arrive at or depart from the airport for a particular time period, and display the aircraft arrival and departure analysis in a single integrated display.

Although airport infrastructure may be fixed, airfield traffic may increase. For example, airlines may increase flights to and/or from an airport in order to satisfy demand from travelers for air travel. Accordingly, managing throughput of airport traffic at an airport utilizing existing airport infrastructure may be a challenge. For example, expediting traffic to increase aircraft throughput at an airport while directing aircraft safely through the airfield can be a challenge.

An airport operations center (APOC) for the airport may need to manage an increased airline and passenger throughput with the same fixed airport infrastructure. However, current systems may not provide a user, such as an APOC supervisor, with the information needed to efficiently manage airside and terminal side airport infrastructure. This lack of information can lead to delays for passengers and/or airlines.

Airfield traffic status management, in accordance with the present disclosure, can allow a user, such as an airport operations center controller, to expedite aircraft traffic at an airport. For example, the user can quickly determine the status of aircraft arriving at the airport and/or aircraft departing from the airport and reassign resources in the event of delays or other issues. Airfield traffic status management can be adaptable to different airport systems and layouts, and can provide for a safe and efficient way to increase aircraft throughput at an airport while utilizing existing airport infrastructure, which can reduce delays for passengers and/or airlines.

Airfield traffic status management can be displayed on a single integrated display. Displaying the airfield traffic status management in a single integrated display can allow the user or others to quickly determine awareness regarding airport operations. A user, as used herein, may include an airport operations center controller, airport employee, air traffic controller, a system engineer, a duty engineer, and/or a shift engineer, among other users.

In the following detailed description, reference is made to the accompanying drawings that form a part hereof. The drawings show by way of illustration how embodiments of the disclosure may be practiced.

These embodiments are described in sufficient detail to enable those of ordinary skill in the art to practice embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 100 may reference element "00" in FIG. 1, and a similar element may be referenced as 200 in FIG. 2.

FIG. 1 is an illustration of a display provided on a user interface (e.g., user interface 652, as described in connection with FIG. 6) showing an aircraft arrival and departure analysis in a graphical view 100, generated in accordance with embodiments of the present disclosure. As illustrated in FIG. 1, the aircraft arrival and departure analysis (e.g., graphical view 100) can include aircraft scheduled to arrive 102, aircraft scheduled to depart 104, a selected particular time period 106, aircraft scheduled to arrive at or depart from the airport 108 for the selected particular time period, time slots 110, modify time slots 112, and graphical view toggle 114.

The aircraft arrival and departure analysis can be generated by a computing device (e.g., computing device 646, as described in connection with FIG. 6) based on airfield information associated with an airfield of an airport. Airfield information can include, for example, information associated with aircraft arriving at and/or departing from the airport, capacity information associated with the airport, including aircraft capacity (e.g., an amount of aircraft at the airport), terminal capacity (e.g., an amount of passengers at the airport, occupied parking stands having an aircraft and corresponding gates, unoccupied/available parking stands and corresponding gates, etc.), a status of each aircraft at the airport (e.g., landing, parked, push-back, taxiing, taking-off, etc.), among other types of airfield information. Airfield information associated with an airfield of an airport can be received by the computing device from various systems of the airport, including airfield sensors, flight information systems, flight data processing systems, airport operations databases, and/or other third party systems.

The aircraft arrival and departure analysis can include aircraft scheduled to arrive 102. Aircraft scheduled to arrive 102 can include aircraft scheduled to arrive at the airport.

As illustrated in FIG. 1, aircraft scheduled to arrive 102 can be shown in graphical view 100. For example, the graphical view 100 can show an amount of aircraft scheduled to arrive 102 at the airport at various times. For instance, in the example illustrated in FIG. 1, the current time may be 9:40 AM. A user of the aircraft arrival and departure analysis can view aircraft scheduled to arrive 102 at the airport at various times throughout the day. For example, a user of the aircraft arrival and departure analysis can view aircraft scheduled to arrive 102 at the airport at, for instance, a particular time period or at a particular time, as is further described herein.

The aircraft arrival and departure analysis can include aircraft scheduled to depart 104. Aircraft scheduled to depart 104 can include aircraft scheduled to depart from the airport.

Similar to aircraft scheduled to arrive 102, aircraft scheduled to depart 104 can be shown in graphical view 100. For example, the graphical view 100 can show an amount of aircraft scheduled to depart 104 from the airport at various times. For instance, the current time may be 9:40 AM. A user of the aircraft arrival and departure analysis can view aircraft scheduled to depart 104 from the airport at various times throughout the day. For example, a user of the aircraft arrival and departure analysis can view aircraft scheduled to depart 104 from the airport at, for instance, a particular time period 106 or at a particular time, as is further described herein.

Although aircraft scheduled to arrive 102 and aircraft scheduled to depart 104 are both illustrated in FIG. 1 in the graphical view 100, embodiments of the present disclosure are not so limited. For example, graphical view 100 can include only aircraft scheduled to arrive 102 or only aircraft scheduled to depart 104. For instance, graphical view 100 can display aircraft scheduled to arrive 102 and aircraft scheduled to depart 104 separately. For instance, a user can toggle, via graphical view toggle 114, whether aircraft scheduled to arrive 102 are displayed in graphical view 100 separately from aircraft scheduled to depart 104, whether aircraft scheduled to depart 104 are displayed in graphical view 100 separately from aircraft scheduled to arrive 102, and/or whether aircraft scheduled to arrive 102 and aircraft scheduled to depart 104 are displayed simultaneously in graphical view 100. In some examples, graphical view toggle 114 can display coordinated and/or uncoordinated aircraft, as is further described in connection with FIG. 3.

As shown in FIG. 1, graphical view 100 can include a plurality of time slots 110. Each respective time slot 110 of graphical view 100 can include aircraft scheduled to arrive 102 and/or aircraft scheduled to depart 104 in that respective time slot. For example, in the example illustrated in FIG. 1, graphical view 100 includes ten minute time slots; however, embodiments are not limited to a particular number of time slots. A user may determine, based on the graphical view 100, an amount of aircraft scheduled to arrive 102 at the airport and/or an amount of aircraft scheduled to depart 104 from the airport in a given ten minute time slot.

For instance, in the time slot 110 of 9:50 AM to 10:00 AM illustrated in FIG. 1, a user can determine that the amount of aircraft scheduled to arrive 102 at the airport between 9:50 AM and 10:00 AM increases slightly and then decreases slightly. Similarly, based on the amount of aircraft scheduled to depart 104 from the airport in graphical view 100, a user can determine that the amount of aircraft scheduled to depart 104 from the airport between 9:50 AM and 10:00 AM increases slightly and then decreases slightly.

In the example illustrated in FIG. 1, graphical view 100 includes ten minute time slots 110 from 9:40 AM to 11:30 AM. However, embodiments of the present disclosure are not limited to graphical view 100 including time slots 110 up to 11:30 AM. For example, graphical view 100 can be scrollable such that a user may view time slots 110 beyond 11:30 AM.

Although time slots 110 are described as being ten minute time slots, embodiments of the present disclosure are not so limited. For example, the computing device can modify a length of time slots 110. A user may modify the length of time slots 110 by utilizing modify time slots 112. For example, a user may modify the length of time slots 110 via modify time slots 112 to change the length of time slots 110 to five minutes, thirty minutes, one hour, six hours, or any other length of time.

In response to a modification in the length of time slots 110, an amount of aircraft scheduled to arrive 102 at the airport and/or an amount of aircraft scheduled to depart 104 from the airport in a given time slot 110 may change. For example, a thirty minute time slot may include a higher amount of aircraft scheduled to arrive 102 at the airport and/or depart 104 from the airport than a ten minute time slot 110 (e.g., more aircraft may be arriving and/or departing in a time slot from 10:30 AM to 11:00 AM relative to a time slot from 10:30 AM to 10:40 AM).

Graphical view 100 can include a graphical representation of an amount of aircraft scheduled to arrive 102 at the airport or an amount of aircraft scheduled to depart 104 from the airport for a particular time period 106. For example, a user may select a particular time period 106 as being from 10:10 AM to 10:22 AM. Graphical view 100 can include a graphical representation of the amount of aircraft scheduled to arrive at or depart from the airport 108 from 10:10 AM to 10:22 AM. For example, from 10:10 AM to 10:22 AM, aircraft with flight numbers EK 003, EK 232, and EK 005 can be scheduled to be arriving at the airport (e.g., flight EK 003 is scheduled to arrive at the airport at 10:12 AM, flight EK 232 is scheduled to arrive at the airport at 10:14 AM, flight EK 005 is scheduled to arrive at the airport at 10:16 AM), and aircraft with flight number QA 1050 can be scheduled to be departing from the airport (e.g., flight QA 1050 is scheduled to depart from the airport at 10:16 AM).

The particular time period 106 can be selected by a user. For example, a user can select any time period in graphical view 100. The computing device can, in response to the selection of particular time period 106, display the aircraft scheduled to arrive at the airport 102 in the particular time period 106. Additionally, the computing device can, in response to the selection of particular time period 106, display the aircraft scheduled to depart 104 from the airport in the particular time period 106.

The aircraft arrival and departure analysis can include aircraft that have arrived at the airport in the graphical view 100. For example, although graphical view 100 is illustrated as showing the current time as 9:40 AM, and the aircraft scheduled to arrive at the airport in graphical view 100, embodiments of the present disclosure are not so limited. For example, graphical view 100 can include aircraft that have arrived at the airport prior to the current time of 9:40 AM. In other words, graphical view 100 can include historical data, including aircraft that have previously arrived at the airport.

The graphical view 100 can be scrollable to view aircraft that have arrived at the airport prior to the current time. For example, graphical view 100 can be scrollable to view time slots prior to the current time. The time slots prior to the current time can include aircraft that have arrived at the airport prior to the current time.

Similarly, the aircraft arrival and departure analysis can include aircraft that have departed from the airport in the graphical view 100. For example, graphical view 100 can include aircraft that have departed from the airport prior to the current time of 9:40 AM. In other words, graphical view 100 can include historical data, including aircraft that have previously arrived at the airport. The graphical view 100 can be scrollable to view aircraft that have departed from the airport prior to the current time. For example, graphical view 100 can be scrollable to view time slots prior to the current time. The time slots prior to the current time can include aircraft that have departed from the airport prior to the current time.

The computing device can include a user interface (e.g., user interface 652, as is further described in connection with FIG. 6. The user interface can display the aircraft arrival and departure analysis in a single integrated display.

Figure 2:
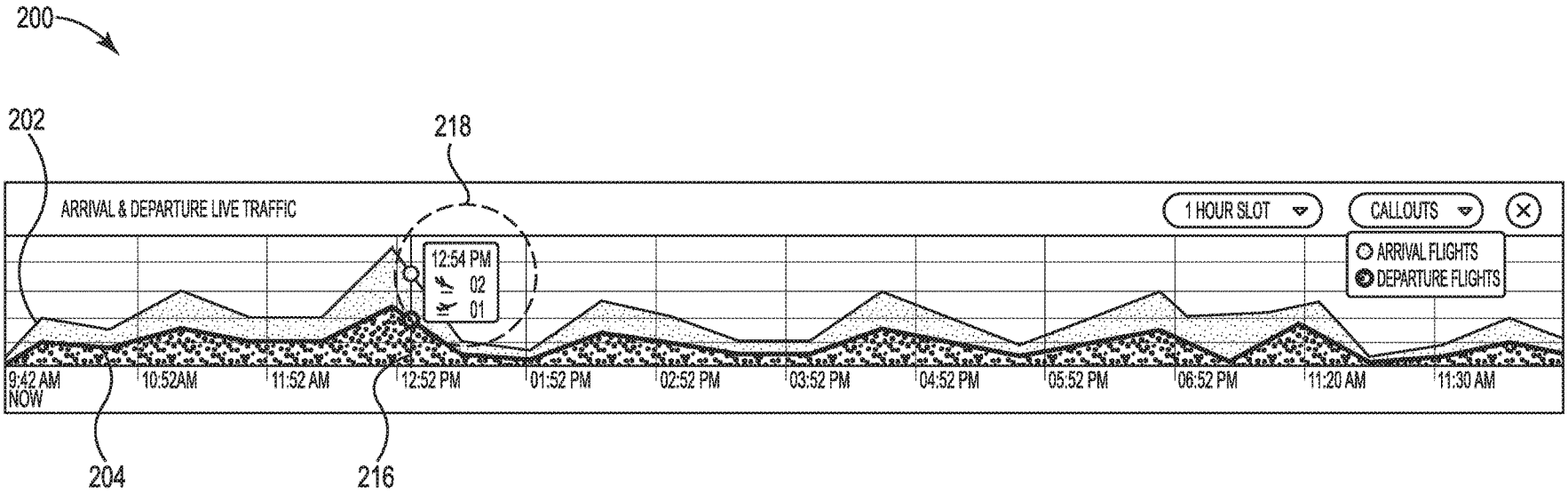
FIG. 2 is an illustration of a display provided on a user interface showing an aircraft arrival and departure analysis in a graphical view, generated in accordance with embodiments of the present disclosure.

FIG. 2 is an illustration of a display provided on a user interface (e.g., user interface 652, as described in connection with FIG. 6) showing an aircraft arrival and departure analysis in a graphical view 200, generated in accordance with embodiments of the present disclosure. As illustrated in FIG. 2, the graphical view 200 (e.g., graphical view 100, previously described in connection with FIG. 1) can include aircraft scheduled to arrive 202 (e.g., aircraft scheduled to arrive 102, previously described in connection with FIG. 1), aircraft scheduled to depart 204 (e.g., aircraft scheduled to depart 104, previously described in connection with FIG. 1), selected particular time 216, and aircraft arriving to and/or departing from the airport at the particular time 218.

Graphical view 200 can include a graphical representation of an amount of aircraft scheduled to arrive 202 at the airport and/or an amount of aircraft scheduled to depart 204 from the airport at a particular time 216. For example, in the example illustrated in FIG. 2, a user has selected a particular time 216 as being 12:54 PM. Accordingly, graphical view 200 can include a graphical representation of the amount of aircraft scheduled to arrive at or depart from the airport at 12:54 PM. For example, at 12:54 PM, aircraft with flight number 02 can be scheduled to be arriving at the airport (e.g., flight 02 is scheduled to arrive at the airport at 12:54 PM), and aircraft with flight number 01 can be scheduled to be departing from the airport (e.g., flight 01 is scheduled to depart from the airport at 12:54 PM), as shown in FIG. 2.

The particular time 216 can be selected by a user. For example, a user can select any time in graphical view 200. The computing device can, in response to the selection of particular time 216, display the aircraft scheduled to arrive at the airport at the particular time 218. Additionally, the computing device can, in response to the selection of particular time 216, display the aircraft scheduled to depart from the airport at the particular time 218.

In some examples, the user selection of particular time 216 can include a user hovering a cursor over that particular time in graphical view 200. For example, a user can hover a cursor over the particular time 216 to display the amount of aircraft scheduled to arrive 202 at the airport and/or the amount of aircraft scheduled to depart 204 from the airport at the particular time 216.

Figure 3:
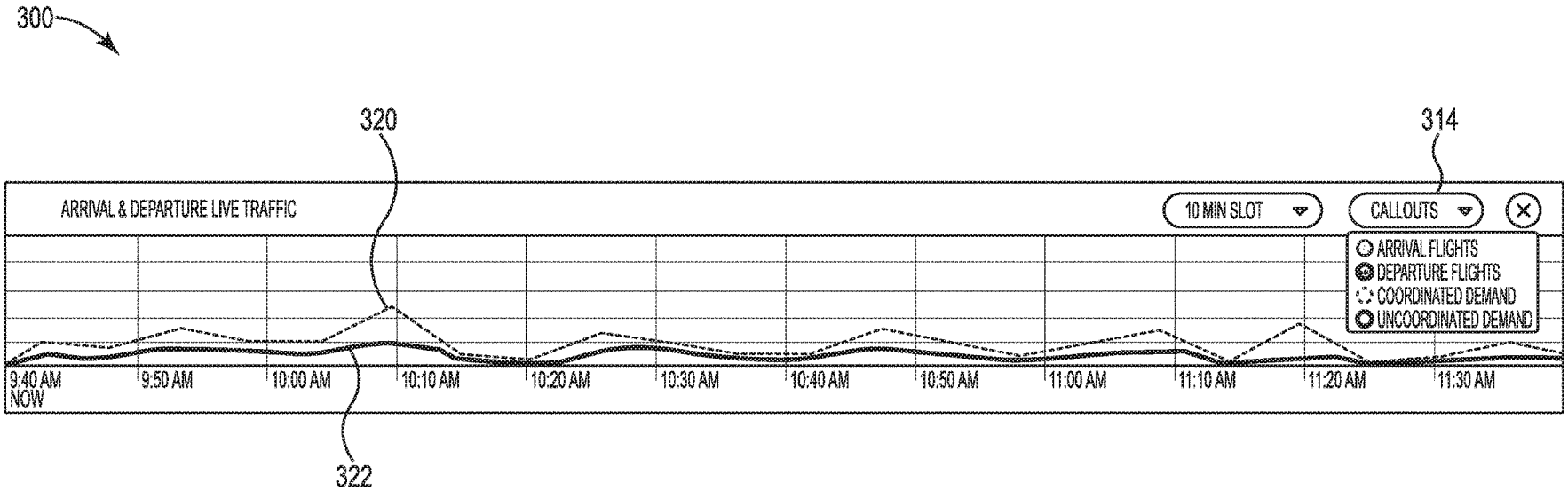
FIG. 3 is an illustration of a display provided on a user interface showing an aircraft arrival and departure analysis in a graphical view, generated in accordance with embodiments of the present disclosure.

FIG. 3 is an illustration of a display provided on a user interface (e.g., user interface 652, as described in connection with FIG. 6) showing an aircraft arrival and departure analysis in a graphical view 300, generated in accordance with embodiments of the present disclosure. As illustrated in FIG. 3, the graphical view 300 (e.g., graphical view 100, 200, previously described in connection with FIGS. 1 and 2, respectively) can include graphical view toggle 314 (e.g., graphical view toggle 114, previously described in connection with FIG. 1), coordinated aircraft 320, and uncoordinated aircraft 322.

The arrival and departure analysis (e.g., graphical view 300) can include a grouping of coordinated aircraft. As used herein, the term "coordinated aircraft" can, for example, refer to aircraft which may be scheduled to arrive at or depart from the airport, but were delayed and/or cancelled. For example, an aircraft that was scheduled to depart from the airport at 10:00 AM but has not yet departed from the airport when the current time is 10:15 AM can be a coordinated aircraft.

In some examples, a grouping of coordinated aircraft 320 can include a subset of aircraft scheduled to arrive at the airport that did not arrive at the airport on time. For example, the subset of aircraft comprising a grouping of coordinated aircraft can include aircraft which were scheduled to arrive by 10:00 AM, but have not yet arrived at the airport when the current time is past 10:00 AM (e.g., the current time is 10:30 AM).

In some examples, a grouping of coordinated aircraft 320 can include a subset of aircraft scheduled to depart from the airport that did not depart from the airport on time. For example, the subset of aircraft comprising a grouping of coordinated aircraft can include aircraft which were scheduled to depart by 10:00 AM, but have not yet departed from the airport when the current time is past 10:00 AM (e.g., the current time is 10:30 AM).

The arrival and departure analysis can include a grouping of uncoordinated aircraft. As used herein, the term "uncoordinated aircraft" can, for example, refer to aircraft which may not be originally scheduled to arrive at or depart from the airport, but arrived at or departed from the airport unexpectedly. A grouping of uncoordinated aircraft can include aircraft that arrive at the airport that are not scheduled to arrive at the airport, and aircraft that depart from the airport that are not scheduled to depart from the airport. For example, uncoordinated aircraft 322 can include an aircraft performing an emergency landing, very important person (VIP) departures and/or arrivals, military aircraft, and/or go-around aircraft (e.g., an aircraft which has deviated from a traffic pattern at the airport, such as an aircraft on a final approach that may have aborted a landing), among other examples of uncoordinated aircraft 322.

Although coordinated aircraft 320 and uncoordinated aircraft 322 are both illustrated in FIG. 3 in the graphical view 300, embodiments of the present disclosure are not so limited. For example, graphical view 300 can include only coordinated aircraft 320 or only uncoordinated aircraft 322. For example, graphical view 300 can display coordinated aircraft 320 and uncoordinated aircraft 322 separately. For instance, a user can toggle, via graphical view toggle 314, whether coordinated aircraft 320 are displayed in graphical view 300 separately from uncoordinated aircraft 322, whether uncoordinated aircraft 322 are displayed in graphical view 300 separately from coordinated aircraft 320, and/or whether coordinated aircraft 320 and uncoordinated aircraft 322 are displayed simultaneously in graphical view 300. In some examples, graphical view toggle 314 can display aircraft scheduled to arrive at the airport and aircraft scheduled to depart from the airport simultaneously with coordinated aircraft 320 and uncoordinated aircraft 322.

Figure 4:
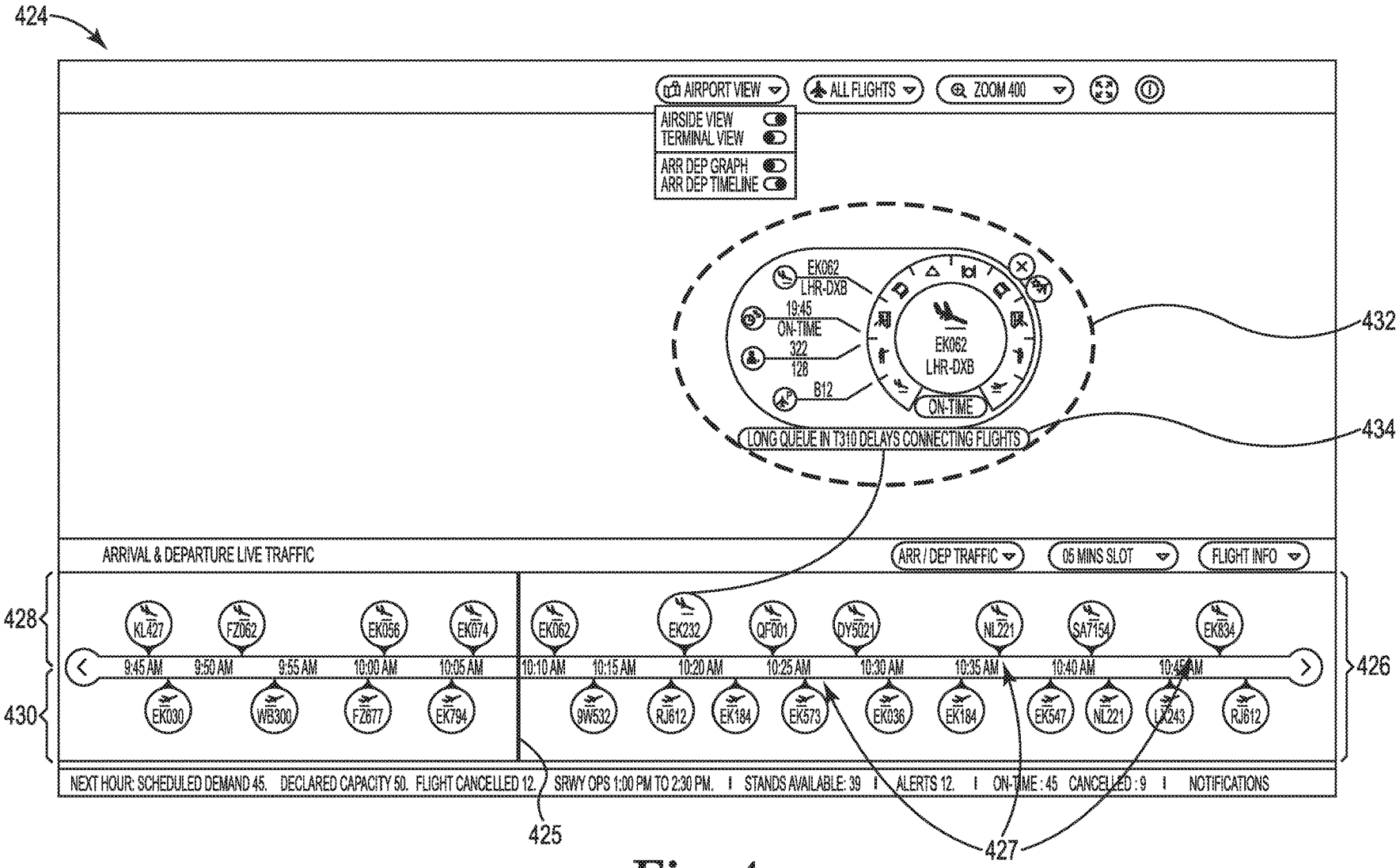
FIG. 4 is an illustration of a display provided on a user interface showing an aircraft arrival and departure analysis in a timeline view, generated in accordance with embodiments of the present disclosure.

FIG. 4 is an illustration of a display provided on a user interface (e.g., user interface 652, as described in connection with FIG. 6) showing an aircraft arrival and departure analysis 424 in a timeline view 426, generated in accordance with embodiments of the present disclosure. As illustrated in FIG. 4, the aircraft arrival and departure analysis 424 (e.g., timeline view 426) can include current time 425, time slots 427, arrival aircraft 428, departure aircraft 430, and an aircraft gate turnaround analysis 432. Aircraft gate turnaround analysis 432 can include a delay alert 434.

As illustrated in FIG. 4, the aircraft arrival and departure analysis 424 can be shown in a timeline view 426. The timeline view 426 can include aircraft arriving at the airport and aircraft departing from the airport. The aircraft arriving at the airport can include aircraft that have arrived prior to the current time (e.g., historical or past aircraft that have arrived at the airport), aircraft arriving at the current time, and/or aircraft scheduled to arrive at the airport (e.g., aircraft arriving at the airport in the future). Similarly, the aircraft departing from the airport can include aircraft that have departed prior to the current time (e.g., historical or past aircraft that have departed from the airport), aircraft departing at the current time, and/or aircraft scheduled to depart from the airport (e.g., aircraft departing from the airport in the future).

Aircraft arrival and departure analysis 424 can include aircraft arriving 428 at the airport in timeline view 426. For example, aircraft arriving 428 at the airport can be displayed in timeline view 426 in chronological order. As used herein, the term "chronological order" can, for example, refer to an arrangement of things following one after another in time. For example, aircraft arriving 428 at the airport can be shown in timeline view 426 one after another in time. For example, in the example illustrated in FIG. 4, an aircraft having a flight number EK 062 may be arriving at the airport at 10:12 AM, an aircraft having a flight number EK 232 may be arriving at the airport at 10:20 AM, an aircraft having a flight number QF 001 may be arriving at the airport at 10:25 AM, etc. The aircraft corresponding to flight numbers EK 062, EK 232, and QF 001 may be displayed in timeline view 426 one after another in time, respectively.

Aircraft arrival and departure analysis 424 can include aircraft departing 430 from the airport in timeline view 426. For example, aircraft departing 430 from the airport can be displayed in timeline view 426 in chronological order (e.g., one after another in time). For example, in the example illustrated in FIG. 4, an aircraft having a flight number 9W532 may be departing from the airport at 10:15 AM, an aircraft having a flight number RJ 612 may be departing from the airport at 10:18 AM, an aircraft having a flight number EK 184 may be departing from the airport at 10:23 AM, etc. The aircraft corresponding to flight numbers 9W532, RJ 612, and EK 184 may be displayed in timeline view 426 one after another in time, respectively.

As illustrated in FIG. 4, timeline view 426 can include time slots 427. Each time slot 427 of timeline view 426 can include aircraft scheduled to arrive 428 and/or aircraft scheduled to depart 430 in each respective time slot 427. In the example illustrated in FIG. 4, timeline view 426 includes five minute time slots; however, embodiments are not limited to a particular number of time slots. A user may determine, based on the timeline view 426, an amount of aircraft scheduled to arrive 428 at the airport and/or an amount of aircraft scheduled to depart 430 from the airport in a given five minute time slot.

For instance, in the time slot 427 of 10:25 AM to 10:30 AM, a user can determine that aircraft having flight numbers QF 001 and DY 5021 are scheduled to arrive at the airport between 10:25 AM to 10:30 AM, and aircraft having flight number EK 573 is scheduled to depart from the airport between 10:25 AM to 10:30 AM.

In the example illustrated in FIG. 4, timeline view 426 includes five minute time slots 427 from 9:45 AM to 10:45 AM. However, embodiments of the present disclosure are not limited to timeline view 426 including time slots 427 from 9:45 AM to 10:45 AM. For example, timeline view 426 can be scrollable such that a user may view time slots 427 prior to 9:45 AM and beyond 10:45 AM.

Although time slots 427 are described as being five minute time slots, embodiments of the present disclosure are not so limited. For example, the computing device can modify a length of time slots 427. For example, the length of time slots 427 may be modified to change the length of time slots 427 to ten minutes, thirty minutes, one hour, six hours, or any other length of time.

In response to a modification in the length of time slots 427, an amount of aircraft scheduled to arrive 428 at the airport and/or an amount of aircraft scheduled to depart 430 from the airport in a given time slot 427 may change. For example, a thirty minute time slot may include a higher amount of aircraft scheduled to arrive 428 at the airport and/or depart 430 from the airport than a five minute time slot (e.g., more aircraft may be arriving and/or departing in a time slot from 10:30 AM to 11:00 AM relative to a time slot from 10:30 AM to 10:35 AM).

The timeline view 426 can be scrollable to view aircraft that have arrived at and/or departed from the airport prior to the current time. For example, timeline view 426 can be scrollable to view time slots prior to the current time. The time slots prior to the current time can include aircraft that have arrived at and/or departed from the airport prior to the current time.

The computing device can generate an aircraft gate turnaround analysis 432 in response to a selection of an aircraft arriving at and/or departing from the airport from timeline view 426. For example, in the example illustrated in FIG. 4, the computing device can generate aircraft gate turnaround analysis 432 in response to a selection of the aircraft having flight number EK 232.

The aircraft gate turnaround analysis 432 can include flight information for a selected aircraft and aircraft turnaround progress information for the selected aircraft. For example, the flight information can include a flight number (e.g., flight EK 232), an inbound flight route (e.g., LHR to DXB), a scheduled flight arrival time (e.g., 10:20), and a flight arrival status (e.g., ON-TIME). The flight information can include a number of total passengers aboard the aircraft (e.g., 322 total passengers) and a number of connecting passengers aboard the aircraft (e.g., 128 connecting passengers). The flight information can include an assigned parking stand and/or terminal gate (e.g., B12).

In some examples, the aircraft gate turnaround analysis 432 can include arrival process information for the aircraft. As used herein, the term "arrival process information for the aircraft" can, for example, refer to processes performed when an aircraft arrives at a destination airport. Arrival process information can include putting wheel chocks under aircraft wheels, setting marker cones, connecting a ground power unit to the aircraft, connecting a jet bridge to the aircraft, deboarding passengers, cleaning the aircraft cabin, unloading passenger baggage, unloading cargo, draining the lavatory, among other arrival process information. In some examples, the number of arrival processes may be dependent on the size of the airport, the size of the aircraft, or a combination thereof.

In some examples, the aircraft gate turnaround analysis 432 can include departure process information for the aircraft. As used herein, the term "departure process information for the aircraft" can, for example, refer to typical processes performed when an aircraft is preparing to depart a destination airport. Departure process information can include catering, refueling the aircraft, water cartage, loading passenger baggage, loading cargo, cooling and/or heating changes to the aircraft cabin, boarding passengers, disconnecting the jet bridge from the aircraft, disconnecting the ground power unit from the aircraft, utilizing a jet/air starter for the aircraft, removing marker cones, removing wheel chocks, aircraft pushback from the gate, among other departure process information. In some examples, the number of departure processes may be dependent on the size of the airport, the size of the aircraft, or a combination thereof.

In some examples, arrival and/or departure process information included in the aircraft gate turnaround analysis 432 can include corresponding icons. The icons can indicate to a user the status of the aircraft turnaround progress. For instance, as illustrated in FIG. 4, process information for the flight can be represented by icons that represent milestones in the aircraft turnaround process. For instance, an icon that is lit up and/or colored green can indicate the process is completed. In some examples, the icon can be colored yellow to indicate the process is in progress. In some examples, an icon that is greyed out can indicate the process is not yet complete.

Aircraft gate turnaround analysis 432 can include a delay alert 434. A delay alert 434 can indicate a delay in the aircraft gate turnaround analysis 432. Delay alert 434 can include delays such as delays related to catering, cleaning, fueling the aircraft, passenger not being boarded, other emergencies at the airport such as an emergency landing, fire, or other emergency situation, aircraft blocking taxiway due to mechanical issue (e.g., tire puncture, engine fault, etc.), allotted parking stand and/or terminal gate to an arriving aircraft is occupied by another aircraft, among other types of delays.

The aircraft arrival and departure analysis 424 can be displayed in a single integrated display. For instance, the aircraft arrival and departure analysis can be displayed in a single integrated display on the user interface of the computing device.

Figure 5:
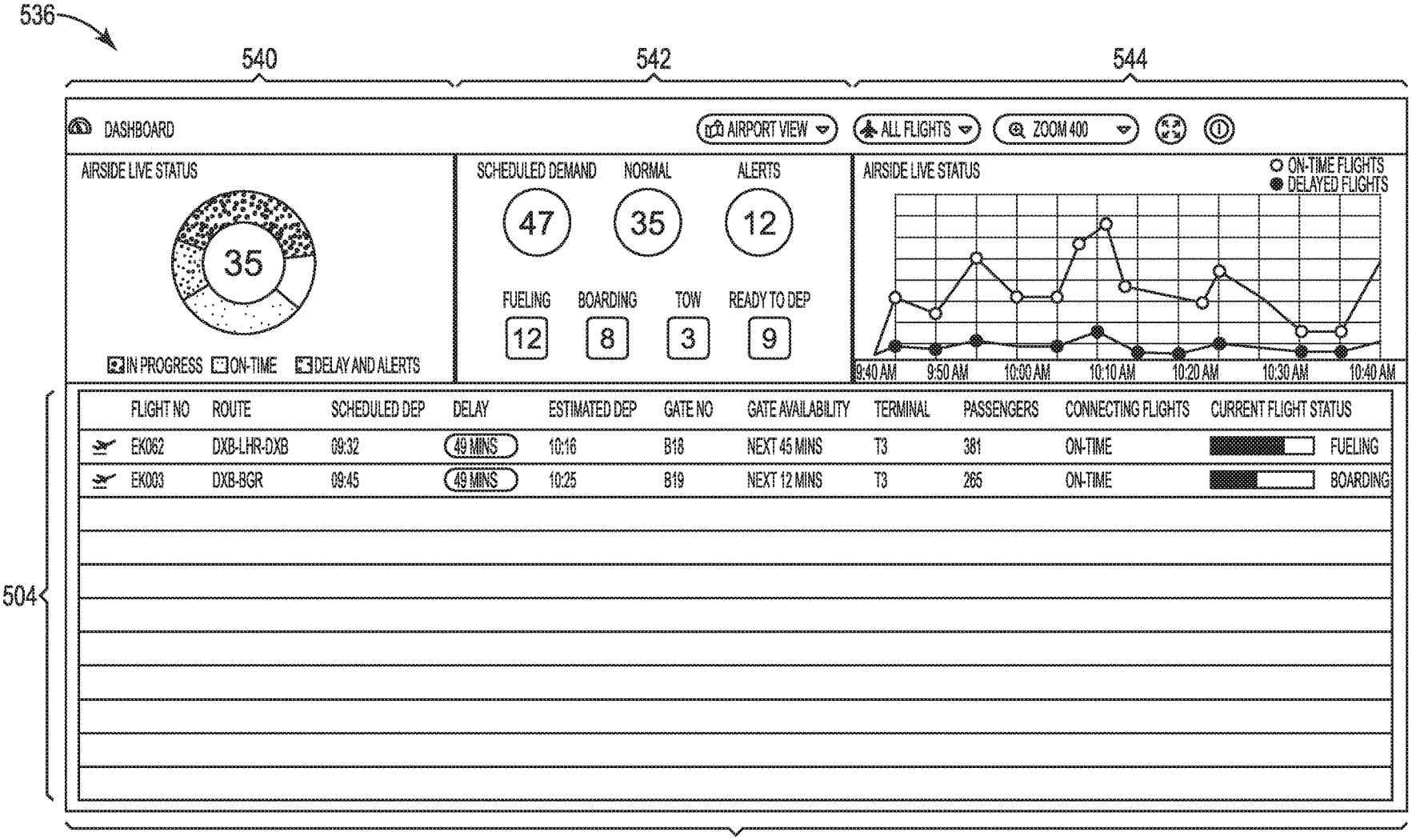
FIG. 5 is an illustration of a display provided on a user interface showing an airport dashboard, in accordance with embodiments of the present disclosure.

FIG. 5 is an illustration of a display provided on a user interface (e.g., user interface 652, as described in connection with FIG. 6) showing an airport dashboard 536, in accordance with embodiments of the present disclosure. The airport dashboard 536 can be generated by a computing device (e.g., computing device 646, as described in connection with FIG. 6) based on airfield information associated with an airfield of an airport. As illustrated in FIG. 5, the airport dashboard 536 can include an aircraft turnaround status table 538, departing aircraft status chart 540, departing aircraft status summary 542, and dashboard graphical view 544.

Airport dashboard 536 can include aircraft scheduled to depart 504 from the airport. The aircraft scheduled to depart 504 from the airport can correspond to aircraft scheduled to depart 104, 204 previously described in connection with FIGS. 1 and 2, respectively.

Airport dashboard 536 can include dashboard graphical view 544. Dashboard graphical view 544 can include aircraft scheduled to depart from the airport that are on time and/or aircraft scheduled to depart from the airport that are delayed. For example, in the example illustrated in FIG. 5, a higher number of aircraft are scheduled to depart from the airport at 10:10 AM than at 10:20 AM. The amount of aircraft that are scheduled to depart from the airport at 10:10 AM that are on time are higher than the amount of aircraft that are scheduled to depart from the airport at 10:10 AM but are delayed.

Dashboard graphical view 544 can quickly give a user an idea of an amount of aircraft scheduled to depart from the airport. Dashboard graphical view 544 can allow the user a snapshot of on time versus delayed departures of aircraft from the airport. The user can take corrective action if, for example, a high number of aircraft scheduled to depart are delayed.

Airport dashboard 536 can include departing aircraft status summary 542. Departing aircraft status summary 542 can include a total amount of aircraft scheduled to depart from the airport in a particular time period. For example, in the example illustrated in FIG. 5, a "Scheduled Demand" can correspond to a total amount of aircraft scheduled to depart from the airport in the particular time period. For example, from the time period between 9:40 AM and 10:40 AM, a total of forty-seven aircraft can be scheduled to depart from the airport.

The departing aircraft status summary 542 can include an amount of aircraft of the total amount of aircraft that are delayed, and an amount of aircraft of the total amount of aircraft that are on time. Continuing with the example from above, of the forty-seven aircraft scheduled to depart from the airport between 9:40 AM and 10:40 AM, thirty-five of the aircraft are "Normal" (e.g., are on time) and twelve of the aircraft are "Alert" (e.g., delayed). In other words, "Normal" can correspond to aircraft that are on time of the total amount of aircraft scheduled to depart from the airport in a particular time period, and "Alerts" can correspond to aircraft that are delayed of the total amount of aircraft scheduled to depart from the airport in a particular time period.

The departing aircraft status summary 542 can include an aircraft turnaround status of aircraft scheduled to depart from the airport. Continuing with the example from above, of the forty-seven aircraft scheduled to depart from the airport between 9:40 AM and 10:40 AM, twelve of the aircraft are fueling, eight of the aircraft are boarding, three of the aircraft are being towed, and nine of the aircraft are ready to depart.

Although the aircraft turnaround status of aircraft scheduled to depart from the airport is described above as including fueling, boarding, towing, and ready to depart, embodiments of the present disclosure are not so limited. For example, the aircraft turnaround status of aircraft scheduled to depart from the airport can include cleaning the aircraft cabin, loading passenger baggage, taxiing, etc.

Although departing aircraft status summary 542 is described above as including a total amount of aircraft scheduled to depart from the airport in a particular time period, embodiments of the present disclosure are not so limited. For example, departing aircraft status summary 542 can include a total amount of aircraft scheduled to depart from the airport at a particular time.

Airport dashboard 536 can include departing aircraft status chart 540. Departing aircraft status chart 540 can include an aircraft turnaround status of a total amount of aircraft scheduled to depart from the airport in a particular time period. Although not shown in FIG. 5 for clarity and so as not to obscure embodiments of the present disclosure, departing aircraft status chart 540 can include forty-seven total aircraft that include an in-progress aircraft turnaround status. For example, forty-seven aircraft may be scheduled to depart from the airport between 9:40 AM and 10:40 AM that include an in-progress aircraft turnaround status.

Departing aircraft status chart 540 can include an amount of the total aircraft which have an on-time aircraft turnaround status. For example, in the example illustrated in FIG. 5, departing aircraft status chart 540 can include thirty-five aircraft that include an in-progress aircraft turnaround status that are on time for their respective scheduled departures from the airport.

Departing aircraft status chart 540 can include an amount of the total aircraft which have a delayed aircraft turnaround status. Although not shown in FIG. 5 for clarity and so as not to obscure embodiments of the present disclosure, departing aircraft status chart 540 can include twelve aircraft that include an in-progress aircraft turnaround status that are delayed for their respective scheduled departures from the airport.

Although departing aircraft status chart 540 is described above as including a total amount of aircraft scheduled to depart from the airport in a particular time period, embodiments of the present disclosure are not so limited. For example, departing aircraft status chart 540 can include a total amount of aircraft scheduled to depart from the airport at a particular time.

Airport dashboard 536 can include an aircraft turnaround status table 538 of aircraft scheduled to depart from the airport. Aircraft turnaround status table 538 can include various status information about aircraft scheduled to depart 504 from the airport. For example, as illustrated in FIG. 5, aircraft turnaround status table 538 can include a flight number, flight route, scheduled departure, delay status, estimated departure, gate number, gate availability, terminal, passengers aboard the departing aircraft, connecting flights, and/or current flight status of departing aircraft, among other status information about aircraft scheduled to depart 504 from the airport.

For example, in the example illustrated in FIG. 5, an aircraft with flight number EK 003 can include a route from DXB to BGR. The aircraft includes a scheduled departure of 9:45 AM. However, flight EK 003 is delayed by forty-nine minutes, resulting in an estimated departure of 10:25 AM. Flight EK 003 is at gate B19 of terminal T3 and includes 265 passengers. Connecting flight information for the 265 passengers on board flight EK 003 indicate ON-Time connections. Flight EK 003 is currently boarding.

The airport dashboard 536 can be displayed in a single integrated display. For instance, the airport dashboard 536 can be displayed in a single integrated display on the user interface of the computing device.

Figure 6:
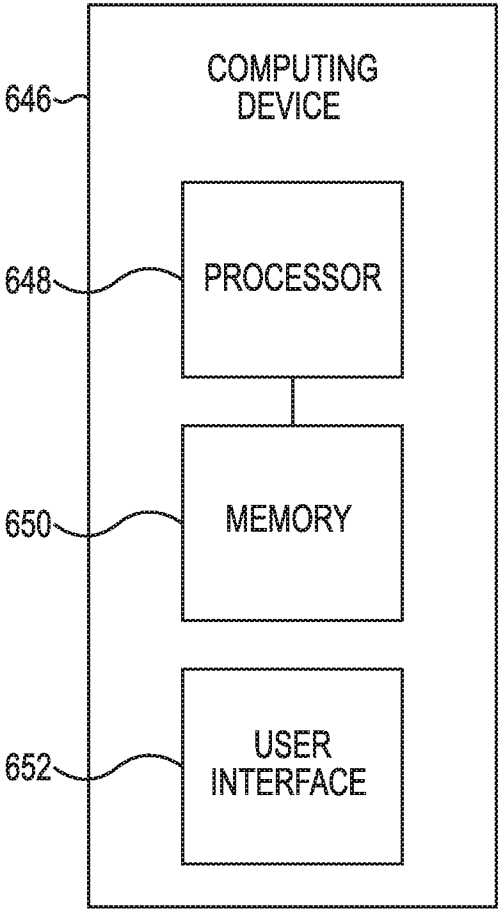
FIG. 6 is a computing device for airfield traffic status management, in accordance with embodiments of the present disclosure.

FIG. 6 is a computing device 646 for airfield traffic status management, in accordance with embodiments of the present disclosure. As illustrated in FIG. 6, computing device 646 can include a user interface 652, memory 650 and a processor 648 for airfield traffic status management in accordance with the present disclosure.

Computing device 646 can be, for example, a laptop computer, a desktop computer, and/or a mobile device (e.g., a smart phone, tablet, personal digital assistant, smart glasses, a wrist-worn device, etc.), and/or redundant combinations thereof, among other types of computing devices.

The memory 650 can be any type of storage medium that can be accessed by the processor 648 to perform various examples of the present disclosure. For example, the memory 650 can be a non-transitory computer readable medium having computer readable instructions (e.g., computer program instructions) stored thereon that are executable by the processor 648 for airfield traffic status management in accordance with the present disclosure. The computer readable instructions can be executable by the processor 648 to redundantly generate the airfield traffic status management.

The memory 650 can be volatile or nonvolatile memory. The memory 650 can also be removable (e.g., portable) memory, or non-removable (e.g., internal) memory. For example, the memory 650 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 650 is illustrated as being located within computing device 646, embodiments of the present disclosure are not so limited. For example, memory 650 can also be located internal to another computing resource (e.g., enabling computer readable instructions to be downloaded over the Internet or another wired or wireless connection).

As illustrated in FIG. 6, computing device 646 includes a user interface 652. For example, the user interface 652 can display airfield traffic status management (e.g., as previously described in connection with FIGS. 1-5) in a single integrated display, as previously described in connection with FIGS. 1-5. A user (e.g., operator) of computing device 646 can interact with computing device 646 via user interface 652. For example, user interface 652 can provide (e.g., display and/or present) information to the user of computing device 646, and/or receive information from (e.g., input by) the user of computing device 646. For instance, in some embodiments, user interface 652 can be a graphical user interface (GUI) that can provide and/or receive information to and/or from the user of computing device 646. The display can be, for instance, a touch-screen (e.g., the GUI can include touch-screen capabilities). Alternatively, a display can include a television, computer monitor, mobile device screen, other type of display device, or any combination thereof, connected to computing device 646 and configured to receive a video signal output from the computing device 646.

As an additional example, user interface 652 can include a keyboard and/or mouse the user can use to input information into computing device 646. Embodiments of the present disclosure, however, are not limited to a particular type(s) of user interface.

User interface 652 can be localized to any language. For example, user interface 652 can display the airfield traffic status management in any language, such as English, Spanish, German, French, Mandarin, Arabic, Japanese, Hindi, etc.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A computing device for airfield traffic status management, comprising:
- a memory;
- a processor configured to execute executable instructions stored in the memory to:
  - receive airport information associated with an airport;
  - generate, using the airport information, an aircraft arrival and departure analysis, wherein the aircraft arrival and departure analysis includes:
    - aircraft scheduled to arrive at the airport in a graphical view;
    - aircraft scheduled to depart from the airport in the graphical view; and
    - a grouping of coordinated aircraft in the graphical view, wherein the grouping of coordinated aircraft includes:
      - a subset of the aircraft scheduled to arrive at the airport that did not arrive at the airport on time; and
      - a subset of the aircraft scheduled to depart from the airport that did not depart from the airport on time;
    - wherein the graphical view includes a load graph representation of an amount of aircraft scheduled to arrive at or depart from the airport for a particular time period and the grouping of coordinated aircraft for the particular time period; and
- a user interface configured to display the aircraft arrival and departure analysis in a single integrated display.

2. The computing device of claim 1, wherein the processor is configured to execute the instructions to:
- receive a selection of the particular time period in the graphical view; and
- display in the single integrated display, in response to the selection of the particular time period:
  - the aircraft scheduled to arrive at the airport in the selected particular time period; and
  - the aircraft scheduled to depart from the airport in the selected particular time period.

3. The computing device of claim 1, wherein the processor is configured to execute the instructions to:
- receive an input of a particular time from a user; and
- display in the single integrated display, in response to receiving the input of the particular time:
  - the aircraft scheduled to arrive at the airport at the selected particular time; and
  - the aircraft scheduled to depart from the airport at the selected particular time.

4. The computing device of claim 1, wherein the arrival and departure analysis includes a grouping of uncoordinated aircraft, wherein the grouping of uncoordinated aircraft includes:
- aircraft that arrive at the airport that are not scheduled to arrive at the airport; and
- aircraft that depart the airport that are not scheduled to depart from the airport.

5. The computing device of claim 1, wherein the graphical view includes a plurality of time slots, wherein each respective time slot includes aircraft scheduled to arrive at the airport and aircraft scheduled to depart from the airport in that respective time slot.

6. The computing device of claim 5, wherein the processor is configured to execute the instructions to modify a length of the plurality of time slots.

7. A non-transitory computer readable medium having computer readable instructions stored thereon that are executable by a processor to:
- receive airport information associated with an airport;
- generate, using the airport information, an aircraft arrival and departure analysis, wherein the aircraft arrival and departure analysis includes:
  - aircraft arriving at the airport in a graphical view and a timeline view;
  - aircraft departing from the airport in the graphical view and the timeline view; and
  - a grouping of coordinated aircraft in the graphical view, wherein the grouping of coordinated aircraft includes:

a subset of aircraft scheduled to arrive at the airport that did not arrive at the airport on time; and a subset of aircraft scheduled to depart from the airport that did not depart from the airport on time;

wherein the graphical view includes a load graph representation of an amount of aircraft scheduled to arrive at or depart from the airport for a particular time period and the grouping of coordinated aircraft for the particular time period;

generate, using the airport information, an airport dashboard, wherein the airport dashboard includes:

the aircraft scheduled to depart from the airport; and a turnaround status of the aircraft scheduled to depart from the airport;

display the aircraft arrival and departure analysis and the airport dashboard in a single integrated display.

8. The computer readable medium of claim 7, wherein the aircraft arriving at the airport in the timeline view includes aircraft that have arrived at the airport and aircraft scheduled to arrive at the airport in chronological order.

9. The computer readable medium of claim 7, wherein the aircraft departing from the airport in the timeline view includes aircraft that have departed from the airport and aircraft scheduled to depart from the airport in chronological order.

10. The computer readable medium of claim 7, wherein the airport dashboard includes a dashboard graphical view of delay information.

11. The computer readable medium of claim 10, wherein the delay information includes:

aircraft scheduled to depart from the airport that are on time; and aircraft scheduled to depart from the airport that are delayed.

12. The computer readable medium of claim 7, wherein the timeline view includes a plurality of time slots, wherein each respective time slot includes:

aircraft scheduled to arrive at the airport in that respective time slot; and aircraft scheduled to depart from the airport in that respective time slot.

13. The computer readable medium of claim 7, wherein the airport dashboard includes a departing aircraft status summary, including:

a total amount of aircraft scheduled to depart from the airport in a particular time period, including an amount of aircraft of the total amount of aircraft that are on time and an amount of aircraft of the total amount of aircraft that are delayed; and an aircraft turnaround status of aircraft scheduled to depart from the airport.

14. The computer readable medium of claim 7, wherein the airport dashboard includes a departing aircraft status chart, including:

an aircraft turnaround status of a total amount of aircraft scheduled to depart from the airport in a particular time period;

an amount of aircraft of the total amount of aircraft which have a delayed aircraft turnaround status; and an amount of aircraft of the total amount of aircraft which have an on time aircraft turnaround status.

15. A computer implemented method for airfield traffic status management, comprising:

receiving, by a computing device, airport information associated with an airport;

generating, by a computing device using the airport information, an aircraft arrival and departure analysis, wherein the aircraft arrival and departure analysis includes:

aircraft arriving at the airport in a graphical view and a timeline view;

aircraft departing from the airport in the graphical view and the timeline view; and a grouping of coordinated aircraft in the graphical view, wherein the grouping of coordinated aircraft includes:

a subset of aircraft scheduled to arrive at the airport that did not arrive at the airport on time; and a subset of aircraft scheduled to depart from the airport that did not depart from the airport on time;

wherein the graphical view includes a load graph representation of an amount of aircraft scheduled to arrive at or depart from the airport for a particular time period and the grouping of coordinated aircraft for the particular time period;

generating, by the computing device using the airport information, an airport dashboard, wherein the airport dashboard includes:

aircraft scheduled to depart from the airport; and a turnaround status of the aircraft scheduled to depart from the airport; and displaying, on a user interface of the computing device, the aircraft arrival and departure analysis and the airport dashboard in a single integrated display.

16. The method of claim 15, wherein generating the airport dashboard includes generating a dashboard graphical view of:

aircraft scheduled to depart from the airport that are on time; and aircraft scheduled to depart from the airport that are delayed.

17. The method of claim 15, wherein the aircraft arrival and departure analysis includes:

aircraft that have arrived at the airport in at least one of the graphical view and the timeline view; and aircraft that have departed from the airport in at least one of the graphical view and the timeline view.

18. The method of claim 15, wherein the method includes generating, by the computing device in response to a selection of an aircraft arriving at the airport or an aircraft departing from the airport from the timeline view, an aircraft gate turnaround analysis for the selected aircraft.

19. The method of claim 18, wherein the aircraft gate turnaround analysis includes a delay alert.

* * * * *